US007607229B2

(12) United States Patent
Motohashi et al.

(10) Patent No.: US 7,607,229 B2
(45) Date of Patent: Oct. 27, 2009

(54) ELECTRIC RAZOR

(75) Inventors: Ryo Motohashi, Hikone (JP); Hiroaki Shimizu, Hikone (JP); Noboru Kobayashi, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 258 days.

(21) Appl. No.: 11/658,555

(22) PCT Filed: Jul. 25, 2005

(86) PCT No.: PCT/JP2005/013560

§ 371 (c)(1),
(2), (4) Date: Jan. 25, 2007

(87) PCT Pub. No.: WO2006/011440

PCT Pub. Date: Feb. 2, 2006

(65) Prior Publication Data

US 2008/0307654 A1 Dec. 18, 2008

(30) Foreign Application Priority Data

Jul. 30, 2004 (JP) ..... 2004-224475

(51) Int. Cl.
*B26B 19/28* (2006.01)
*B26B 19/12* (2006.01)

(52) U.S. Cl. ..... 30/43.7; 30/43.91; 30/44

(58) Field of Classification Search ..... 30/44, 30/43.7–43.92, 345.51
See application file for complete search history.

(56) References Cited

U.S. PATENT DOCUMENTS 2,331,501 A 10/1943 Rand, Jr. et al.
2,773,306 A * 12/1956 Ranson ..... 30/43.92
4,428,117 A 1/1984 Horii et al.
5,632,087 A 5/1997 Motohashi et al.
5,921,134 A * 7/1999 Shiba et al. ..... 30/43.92
6,226,871 B1 * 5/2001 Eichhorn et al. ..... 30/43.92

(Continued)

FOREIGN PATENT DOCUMENTS

CN 1089659 8/2002

(Continued)

OTHER PUBLICATIONS

Office Action dated Mar. 28, 2008, issued in the Chinese patent application No. 200580025403.0 and its translation.

(Continued)

*Primary Examiner*—Stephen Choi
(74) *Attorney, Agent, or Firm*—Edwards Angell Palmer & Dodge LLP

(57) ABSTRACT

An electric razor including an actuator, an outer cutter and an inner cutter. The actuator has a first vibrator and a second vibrator. The outer cutter and the inner cutter are respectively supported at the first vibrator and the second vibrator so that the cutters can slide against each other. The actuator vibrates the first vibrator and the second vibrator so that the vibrators slide in reciprocation toward opposite directions to each other. Even though vibration of the first vibrator is interrupted by external force through the outer cutter, the second vibrator relatively vibrates so as to slide in reciprocation with respect to the first vibrator and therefore it is easy to meet specified shaving performance.

3 Claims, 5 Drawing Sheets

U.S. PATENT DOCUMENTS

| | | | | |
|---|---|---|---|---|
| 6,357,118 | B1 | 3/2002 | Eichhorn et al. | |
| 2003/0094861 | A1* | 5/2003 | Shimizu et al. | 310/36 |

FOREIGN PATENT DOCUMENTS

| | | |
|---|---|---|
| CN | 1091676 | 10/2002 |
| DE | 1151307 | 7/1963 |
| DE | 7126267 | 1/1973 |
| DE | 10242094 | 4/2004 |
| EP | 0 674 979 | 10/1995 |
| JP | 58-74478 | 5/1983 |
| JP | 02-049684 | 2/1990 |
| JP | 07-265559 | 10/1995 |
| JP | 2001-513415 | 9/2001 |

OTHER PUBLICATIONS

Supplementary European Search Report dated Apr. 1, 2008, from the European Patent Office, issued in the prosecution of the European Patent Application No. 05766466.6.

* cited by examiner

ELECTRIC RAZOR

BACKGROUND OF THE INVENTION

1. Field of the Invention

The invention relates to electric razors and more particularly to a reciprocating type electric razor with at least a pair of cutters, i.e., an outer cutter (i.g., foil) and an inner cutter (i.g., blade) that slides in reciprocation with respect to the outer cutter.

2. Description of the Related Art

In the reciprocating type electric razor, the outer cutter (hereinafter also referred to as the "foil") is relatively fixed with respect to the inner cutter (hereinafter also referred to as the "blade"), and only the blade is actuated to slide in reciprocation with respect to the foil. In this case, since the foil does not move with respect to the skin of a user, a shaving range is limited to the range of the foil moved by the user.

A prior art device described in Japanese Patent National Publication No. P2001-513415A (WO99/10141) transmits vibration motion of a motor to a shaving head when converting rotation motion of the motor into reciprocating motion to actuate a blade, and thereby actuates a foil mounted in the shaving head. Thus, by moving the foil, the shaving range can be expanded.

However, the prior art device has a tendency to restrain vibration of the blade when the foil is grasped or rather strongly pressed against the skin. Moreover, the tendency becomes stronger due to moving the foil not directly but by reaction from the side of the blade sliding along the foil. As a result, it becomes difficult to meet the prescribed shaving performance.

SUMMARY OF THE INVENTION

It is therefore an object of the present invention to make it easy to meet specified shaving performance.

The present invention comprises an actuator with a first vibrator and a second vibrator, and an outer cutter and an inner cutter that are respectively supported at the first vibrator and the second vibrator so that the cutters can slide against each other. The actuator vibrates the first vibrator and the second vibrator so that the vibrators slide in reciprocation toward opposite directions to each other. In this structure, even if vibration of the first vibrator is interrupted by an external force through the outer cutter, the second vibrator relatively vibrates so as to slide in reciprocation with respect to the first vibrator and therefore it is easy to meet specified shaving performance. In addition, since each stroke of the outer cutter and the inner cutter can be reduced to half, high speed drive is possible.

In an alternate embodiment of the present invention, the actuator is a linear actuator composed of a stator, a first mover as the first vibrator and a second mover as the second vibrator. The stator is constructed as an electromagnet and supported inside a body of the electric razor. The first mover has a first permanent magnet arranged opposite the electromagnet, and is resiliently supported at the stator. The second mover has a second permanent magnet that has the opposite pole of the first permanent magnet and is arranged opposite the electromagnet, and is resiliently supported at the stator. When the electromagnet is excited, the linear actuator vibrates the first mover and the second mover so that the movers slide in reciprocation toward opposite directions to each other. According to this invention, the outer cutter and the inner cutter can be easily driven in opposite phase.

In another alternate embodiment of the present invention, the electric razor comprises the outer cutter and the inner cutter as a first outer cutter and a first inner cutter, respectively, and further comprises a second outer cutter and a second inner cutter. The first outer cutter and the first inner cutter are respectively supported at the first mover and the second mover so that the cutters can slide against each other. The second outer cutter and the second inner cutter are respectively supported at the second mover and the first mover so that the cutters can slide against each other. According to this invention, the first and second outer cutters as well as the first and second inner cutters can be supported so as to be easy to meet specified shaving performance without increasing the number of movers.

In other alternate embodiment of the present invention, the actuator is a linear actuator composed of a stator as the first vibrator and a mover as the second vibrator. The stator is constructed as an electromagnet and resiliently supported inside a body of the electric razor. The mover has a permanent magnet arranged opposite the electromagnet, and is resiliently supported at the stator. When the electromagnet is excited, the linear actuator not only vibrates the mover so that it slides in reciprocation but also vibrates the stator so that it slides in reciprocation toward opposite directions of the mover by a reaction from the mover to the stator. In this structure, even if vibration of the stator is interrupted by an external force through the outer cutter, the mover relatively vibrates so as to slide in reciprocation with respect to the stator and therefore it is possible to meet specified shaving performance regardless of the vibrating state of the stator.

In other alternate embodiment of the present invention, the mover is resiliently supported at the stator through a pair of elastic retainers. The stator is resiliently supported together with the retainers inside the body of the electric razor through a pair of support arms that resiliently support the retainers inside the body of the electric razor, respectively. According to this invention, vibration of the electric razor can be reduced.

In other alternate embodiment of the present invention, the electric razor comprises the outer cutter and the inner cutter as a first outer cutter and a first inner cutter, respectively, and further comprises a second outer cutter and a second inner cutter. The linear actuator comprises the mover as a first mover and further comprises a second mover with a permanent magnet that is the same pole as the permanent magnet of the first mover and arranged opposite the electromagnet and resiliently supported at the stator. The first outer cutter and the first inner cutter are respectively supported at the stator and the first mover so that the cutters can slide against each other. The second outer cutter and the second inner cutter are respectively supported at the stator and the second mover so that the cutters can slide against each other. In this invention, it is easy to arrange and drive the first and second outer cutters as well as the first and second inner cutters.

In other alternate embodiment of the present invention, the first mover and the second mover slide in reciprocation toward opposite directions to each other so as to absorb vibration in direction of the reciprocation. According to this invention, vibration of the electric razor can be reduced.

In other alternate embodiment of the present invention, the linear actuator comprises the mover as a second mover and further comprises a first mover for exclusive use of vibration cancel. The first mover has a permanent magnet that is the same pole as the permanent magnet of the second mover and arranged opposite the electromagnet, and is resiliently supported at the stator. The first and second movers and the stator slide in reciprocation toward opposite directions to each other so as to absorb vibration in direction of the reciprocation. According to this invention, vibration of the electric razor can be reduced.

In other alternate embodiment of the present invention, the stator and the first and second movers slide in reciprocation toward opposite directions to each other so as to absorb vibration in direction of the reciprocation. According to this invention, vibration of the electric razor can be reduced.

In other alternate embodiment of the present invention, the linear actuator is resiliently supported inside the body of the electric razor so that the actuator can freely vibrate in direction of the reciprocation. According to this invention, vibration of the electric razor can be reduced and also shaving range can be further expanded.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1:
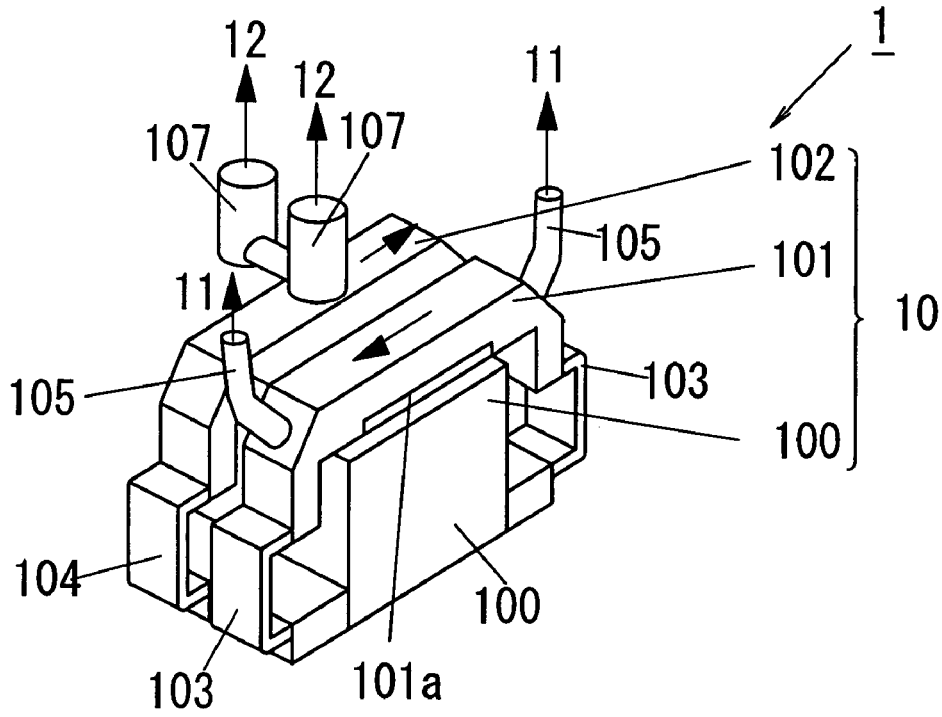
FIG. 1 is a perspective view showing a head of an electric razor of a first embodiment according to the present invention.
Figure 2:
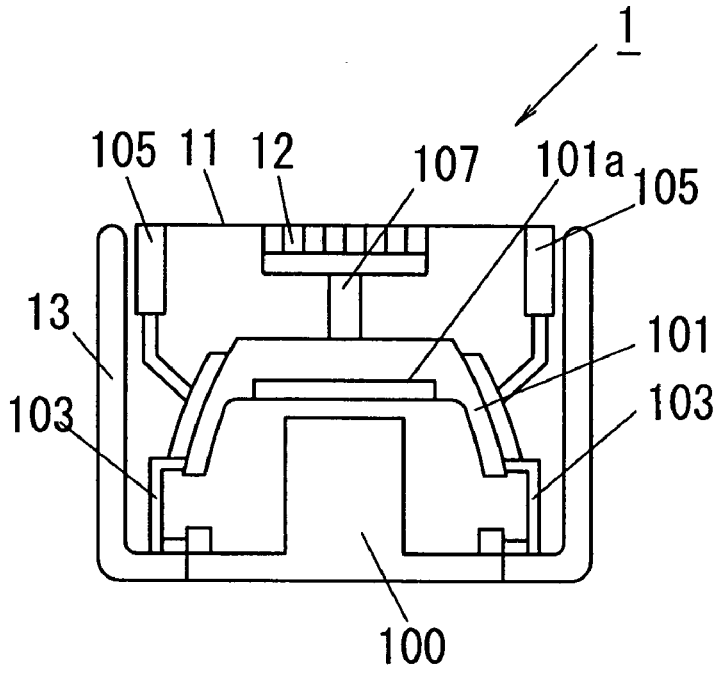
FIG. 2 is a sectional view of the head of FIG. 1.

FIGS. 1 and 2 show a head 1 of an electric razor of a first embodiment according to the present invention. The electric razor of the first embodiment is characterized by the head 1. The head 1 is constructed with a linear actuator 10, at least a pair of cutters, i.e., an outer cutter 11 and an inner cutter 12 actuated with the actuator 10, and a cover 13 enclosing around them.

The actuator 10 includes a stator 100, a first mover 101 and a second mover 102. The stator 100 is constructed as an electromagnet and supported inside a body (not shown) of the electric razor. In the first embodiment, the stator 100 is fixed at the body of the electric razor. The electromagnet is constructed with a stator core, a bobbin insulating the stator core, and a coil wound the bobbin. The stator core is a sintered object of magnetic materials, or a laminate (a magnetic body) made of iron sheets.

The first mover 101 has a first permanent magnet 101*a* and a first yoke (not shown) of a magnetic body. The magnet 101*a* is arranged opposite the electromagnet constructing the stator 100 through a gap. The first yoke is located on the magnet 101*a*.

The second mover 102 has a second permanent magnet (not shown) and a second yoke (not shown) of a magnetic body. The second permanent magnet has the opposite pole of the magnet 101*a* and arranged opposite the electromagnet through a gap. The second yoke is located on the second permanent magnet.

The first mover 101 and second mover 102 are arranged in rows and in parallel with each other so as to slide in reciprocation toward opposite directions to each other when the electromagnet is activated. That is, the mover 101 is resiliently supported at one side of the stator 100 through a pair of elastic retainers 103 and 103, while the mover 102 is resiliently supported at other side of the stator 100 through a pair of elastic retainers (only left retainer 104 is shown). Each retainer also functions as a spring for defining a resonant frequency of vibration system of the head 1.

The outer cutter 11 and the inner cutter 12 are what is called an outer foil and an inner blade, respectively (hereinafter also referred to as a "foil" and a "blade", respectively). These foil 11 and blade 12 are supported at the first mover 101 and the second mover 102 so that they can slide against each other through connector arms 105 and 105 and connectors 107 and 107, respectively.

The first mover side (i.e., mover 101, arms 105 and 105 and foil 11) and the second mover side (i.e., mover 102, connectors 107 and 107 and blade 12) are set so as to become generally equal in mass.

The operation of the first embodiment is now explained. When the electromagnet constructing the stator 100 is activated by supplying the coil with an alternating current, the first mover 101 and the second mover 102 vibrate so as to slide in reciprocation toward opposite directions to each other while bending each retainer. In response to this, the foil 11 and the blade 12 vibrate while sliding with respect to each other.

Thus, by moving the foil 11, the shaving range can be expanded. In addition, since the first mover 101 and the second mover 102 especially slide in opposite phase to each other, vibration in direction of the reciprocation is reduced. As a result, vibration of the electric razor is reduced. In the first embodiment, since the first mover side and the second mover side become generally equal in inertia force in order that both are generally equal in mass, the vibration of the electric razor is further reduced.

In the operation, even though the foil 11 is grasped or rather strongly pressed against the skin, the foil 11 is directly actuated by the first mover 101 as an actuation source and therefore vibration of the foil 11 lasts as long as it is not forcibly interrupted. In other words, the vibration of the foil 11 becomes hard to be interrupted by an external force usually applied. As a result, it is easy to meet specified shaving performance. Moreover, even though the vibration of the first mover 101 is forcibly interrupted, the second mover 102 relatively vibrates so as to slide in reciprocation with respect to the first mover 101 and therefore it is possible to meet the specified shaving performance regardless of the vibration state of the first mover 101.

Figure 3:
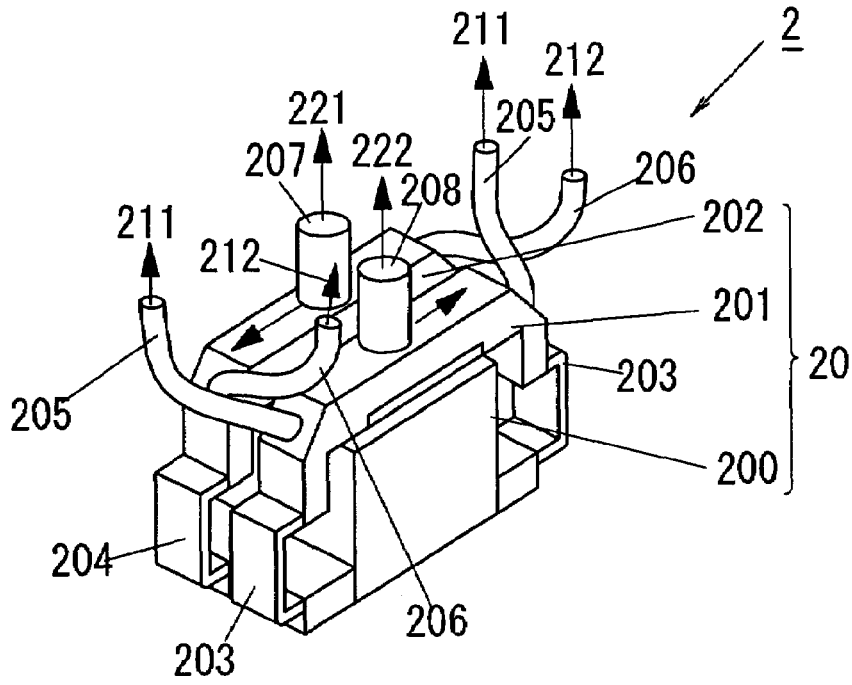
FIG. 3 is a perspective view showing a head of an electric razor of a second embodiment according to the present invention.

FIG. 3 shows a head 2 of an electric razor of a second embodiment according to the present invention. The head 2 includes the above outer cutter (outer foil) and inner cutter (inner blade) as a first outer cutter (foil) 211 and a first inner cutter (blade) 221, respectively, and further includes a second outer cutter (foil) 212 and a second inner cutter (blade) 222.

These foils 211 and 212 and blades 221 and 222 are actuated with a linear actuator 20. The actuator 20 includes a stator 200, a first mover 201 and a second mover 202 as well as those of the first embodiment. The mover 201 is resiliently supported at one side of the stator 200 through a pair of elastic retainers 203 and 203, while the mover 202 is resiliently supported at other side of the stator 200 through a pair of elastic retainers (only left retainer 204 is shown).

The first outer foil 211 and the first inner blade 221 are supported at the first mover 201 and the second mover 202 so that they can slide against each other through connector arms 205 and 205 and connector 207, respectively. The second outer foil 212 and the second inner blade 222 are supported at the second mover 202 and the first mover 201 so that they can slide against each other through connector arms 206 and 206 and connector 208, respectively.

The first mover side (i.e., mover 201, arms 205 and 205, foil 211, connector 208 and blade 222) and the second mover side (i.e., mover 202, arms 206 and 206, foil 212, connector 207 and blade 221) are set so as to become generally equal in mass.

The operation of the second embodiment is now explained. When the electromagnet constructing the stator 200 is activated by supplying the coil with an alternating current, the first mover 201 and the second mover 202 vibrate so as to slide in reciprocation toward opposite directions to each other while bending each retainer. In response to this, not only the foil 211 and the blade 221 but also the foil 212 and the blade 222 vibrate while sliding with respect to each other.

Thus, by moving the foils 211 and 212, the shaving range can be expanded. In addition, since the first mover 201 and the second mover 202 especially slide in opposite phase to each other, vibration in direction of the reciprocation is reduced. As a result, vibration of the electric razor is reduced. In the second embodiment, since the first mover side and the second mover side become generally equal in inertia force in order that both are generally equal in mass, the vibration of the electric razor is further reduced.

In the operation, even though the first outer foil 211 or the second outer foil 212 is grasped or rather strongly pressed against the skin, the first outer foil 211 or the second outer foil 212 is directly actuated by the first mover 201 or the second mover 202 as an actuation source, respectively and therefore vibration of the first outer foil 211 or the second outer foil 212 becomes difficult to be interrupted by the external force usually applied. As a result, it is easy to meet specified shaving performance.

Figure 4:
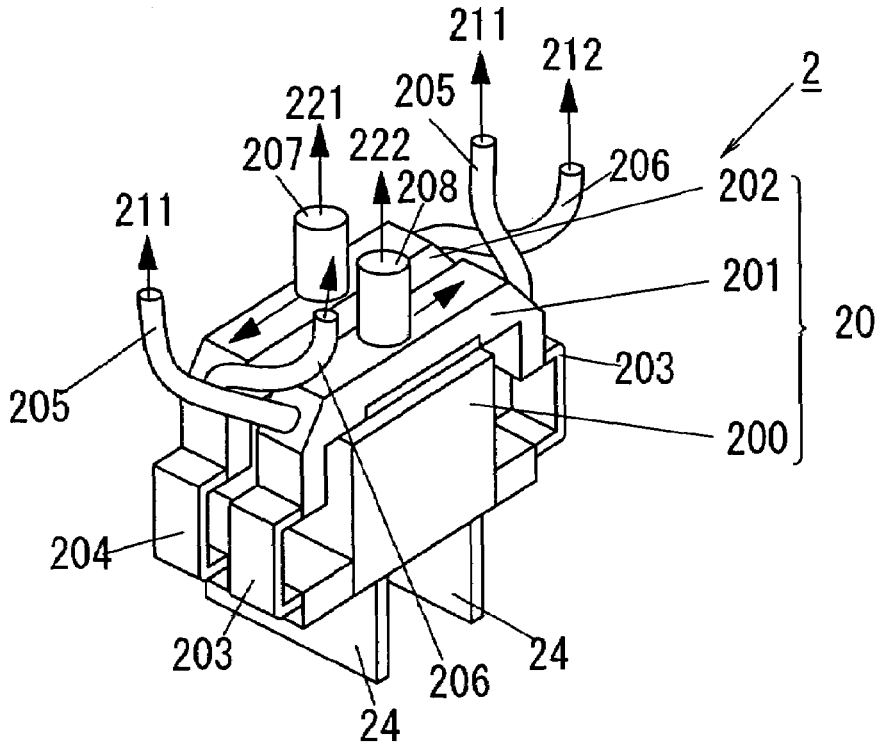
FIG. 4 shows an alternate embodiment of the second embodiment.
Figure 5:
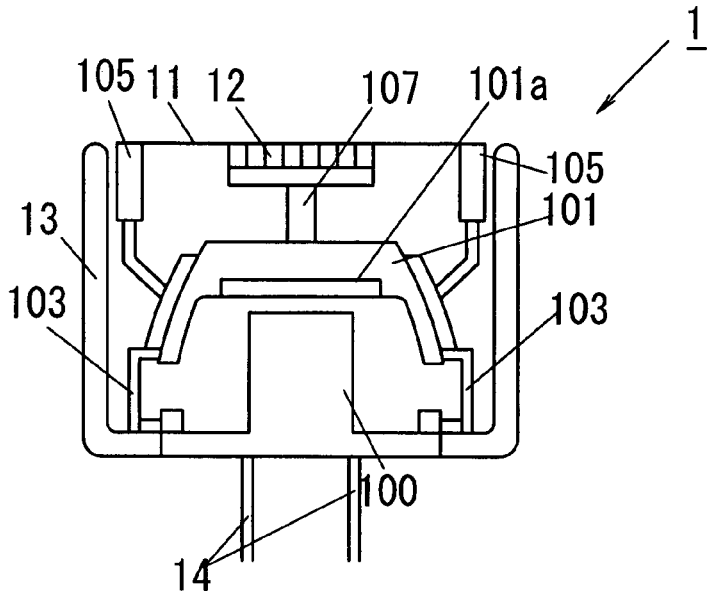
FIG. 5 shows an alternate embodiment of the first embodiment.

In an alternate embodiment of the present invention, the linear actuator is resiliently supported inside the body of the electric razor so as to freely vibrate in the direction of the reciprocation. For example, as shown in FIG. 4, the stator 200 of the actuator 20 is supported inside the body through a pair of elastic support members 24 and 24. Each member 24 is coupled between the stator 200 and a portion inside the body. This configuration as shown in FIG. 5 can be also adapted to the actuator 10 of the first embodiment (cf. a pair of elastic support members 14 and 14). Thus, by resiliently supporting the actuator inside the body, the actuator vibrates while bending each support member by difference of each inertia force in vibration direction of each mover to absorb vibration transmitted to the body side. As a result, the vibration of the electric razor can be reduced, and the shaving range can be further expanded.

Figure 6:
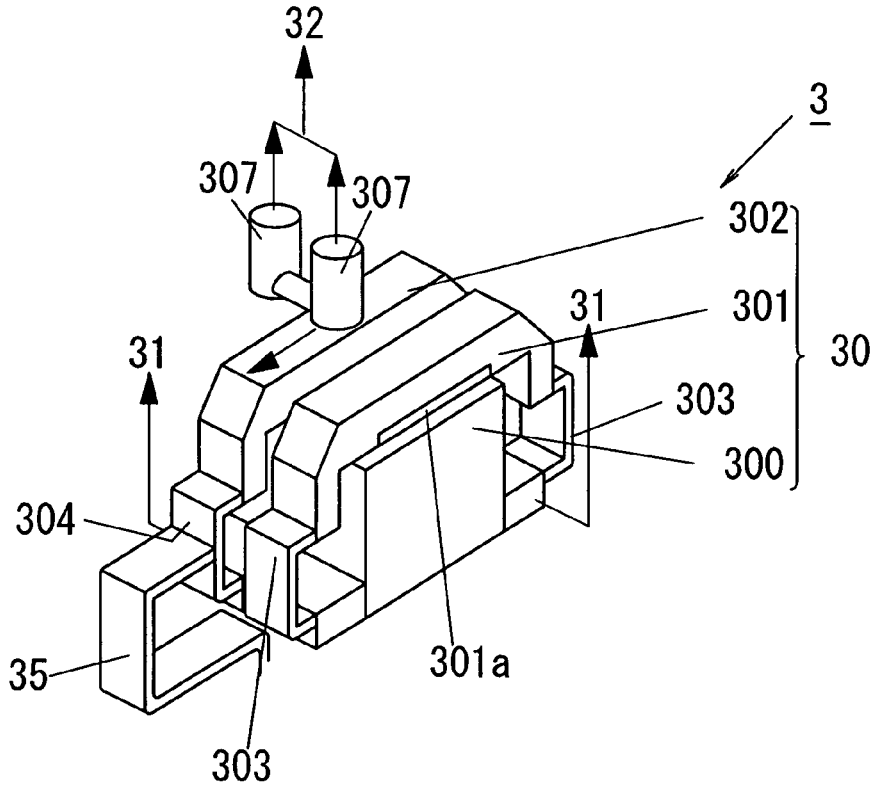
FIG. 6 is a perspective view showing a head of an electric razor of a third embodiment according to the present invention.

FIG. 6 shows a head 3 of an electric razor of a third embodiment according to the present invention. The head 3 includes a linear actuator 30 and at least a pair of cutters, i.e., an outer cutter (foil) 31 and an inner cutter (blade) 32 that are actuated with the actuator 30.

The actuator 30 includes a stator 30, a first mover 301 and a second mover 302. The stator 300 is constructed as an electromagnet and supported inside a body (not shown) of the electric razor.

The first mover 301 has a first permanent magnet 301*a* and a first yoke of a magnetic body (not shown). The magnet 301*a* is arranged opposite the electromagnet constructing the stator 300 through a gap. The first yoke is located on the magnet 301*a*.

The second mover 302 has a second permanent magnet (not shown) and a second yoke of a magnetic body (not shown). The second permanent magnet is arranged opposite the electromagnet through a gap. The second yoke is located on the second permanent magnet.

These first mover 301 and second mover 302 are arranged in rows and in parallel with each other so as to slide in reciprocation when the electromagnet is activated. That is, the mover 301 is resiliently supported at one side of the stator 300 through a pair of elastic retainers 303 and 303, while the mover 302 is resiliently supported at other side of the stator 300 through a pair of elastic retainers (only left retainer 304 is shown).

The first feature of the third embodiment is explained. The stator 300 is resiliently supported inside the body of the electric razor together with retainers 304 and 304 through a pair of support arms (only left arm 35 is shown) so as to slide in reciprocation toward opposite directions of the mover 302 by a reaction from the mover 302. The arms 35 and 35 resiliently support the retainers 304 and 304 inside the body of the electric razor, respectively. Each of the retainers and the support arms also functions as a spring for defining a resonant frequency of vibration system of the head 3. The foil 31 is resiliently supported at the stator 300 through at least a pair of connector arms (not shown). However, between the pair of the connector arms may be continuous.

The second feature of the third embodiment is explained. Though the second mover 302 is utilized in order to actuate the blade 32 through connectors 307 and 307 as well as the first embodiment, the first mover 301 is exclusive use of vibration cancel and supports neither the foil 31 nor the blade 32. In addition, the mover 301 and the magnet 301*a* have mass and pole such as absorb difference of each inertia force of the stator side (i.e., stator 300, each connector arm and foil 31) and the second mover side (i.e., mover 302, connectors 307 and 307 and blade 32). The magnet 301*a* has the same pole as that of the second permanent magnet of the mover 302.

The operation of the third embodiment is now explained. When the electromagnet constructing the stator 300 is activated by supplying the coil with an alternating current, the first mover 301 and the second mover 302 vibrate so as to slide in reciprocation in same direction together while bending each retainer, whereas the stator 300 vibrates so as to slide in reciprocation toward opposite directions of the movers 301 and 302. In response to this, the foil 31 and the blade 32 vibrate while sliding with respect to each other.

Thus, by moving the foil 31, the shaving range can be expanded. The first mover 301 also absorbs the difference of each inertia force of the stator side and the second mover side and therefore vibration of the electric razor can be reduced.

In the operation, when the foil 31 is grasped or rather strongly pressed against the skin, the present electric razor has a tendency to restrain vibration of the stator 300. However, even though the vibration of the stator 300 is interrupted, the second mover 302 relatively vibrates so as to slide in reciprocation with respect to the stator 300 and therefore it is possible to meet specified shaving performance regardless of the vibration state of the stator 300.

In an alternate embodiment of the present invention, the foil 31 is supported at the second mover 302, and the blade 32 is supported at the first mover 301. In this configuration, it is also easy to meet the specified shaving performance.

Figure 7:
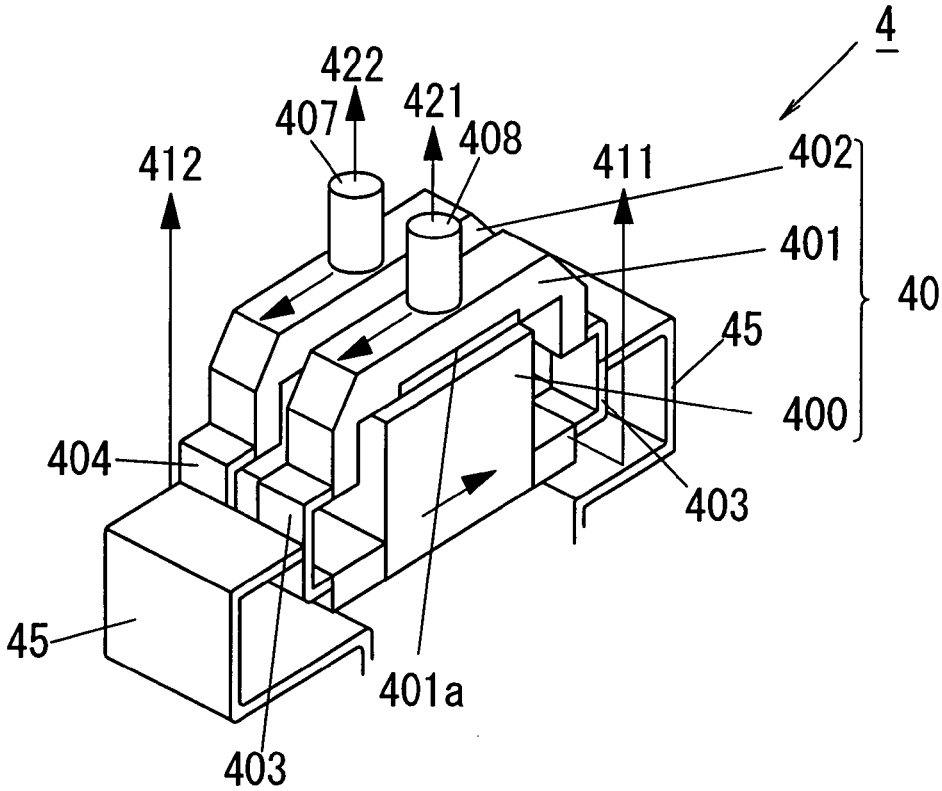
FIG. 7 is a perspective view showing a head of an electric razor of a fourth embodiment according to the present invention.
Figure 8:
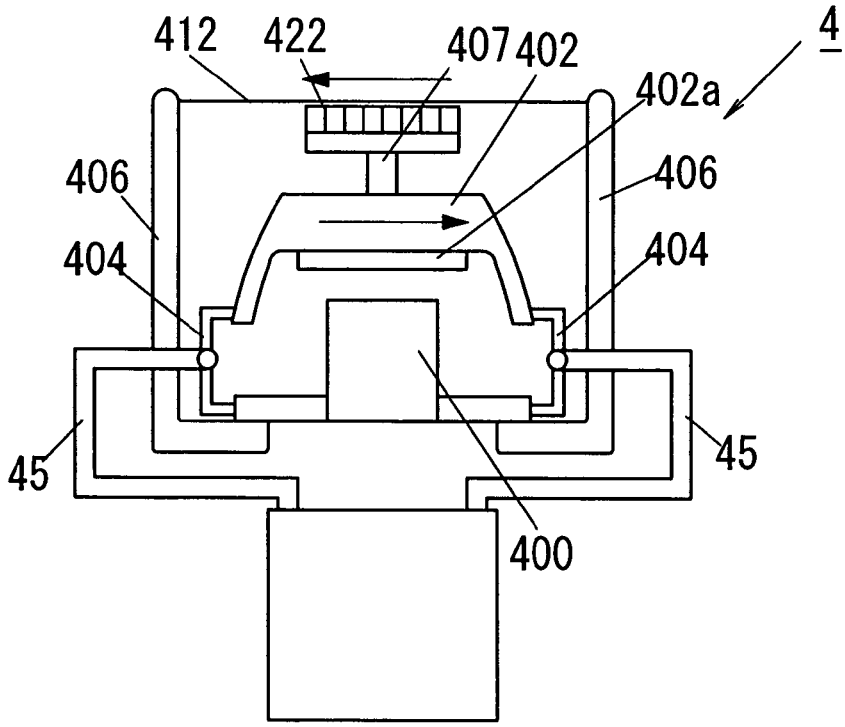
FIG. 8 is a sectional view of the head of FIG. 7.

FIGS. 7 and 8 show a head 4 of an electric razor of a fourth embodiment according to the present invention. The head 4 includes the outer cutter and the inner cutter of the third embodiment as a second outer cutter (foil) 412 and a second inner cutter (blade) 422, respectively, and further includes a first outer cutter (foil) 411 and a first inner cutter (blade) 421.

These foils 411 and 412 and blades 421 and 422 are actuated with a linear actuator 40. The actuator 40 includes a stator 400, a first mover 401 and a second mover 402 as well as those of the third embodiment. The mover 401 is resiliently supported at one side of the stator 400 through a pair of elastic retainers 403 and 403, while the mover 402 is resiliently supported at other side of the stator 400 through a pair of elastic retainers 404 and 404. In FIGS. 7 and 8, 401*a* is a first permanent magnet and 402*a* is a second permanent magnet.

The stator 400 is resiliently supported inside a body of the electric razor together with each retainer through a pair of support arms 45 and 45 so as to slide in reciprocation toward opposite directions of the movers 401 and 402 by a reaction from the movers 401 and 402. Each arm 45 resiliently supports the retainers 403 and 405 inside the body of the electric razor.

The first outer foil 411 and the first inner blade 421 are supported at the stator 400 and the first mover 401 so that they can slide against each other through a pair of connector arms (not shown) and a connector 408, respectively. The second outer foil 412 and the second inner blade 422 are supported at the stator 400 and the second mover 402 so that they can slide against each other through connector arms 406 and 406 and a connector 407, respectively.

The first and second movers side (i.e., movers 401 and 402, connectors 408 and 407, and blades 421 and 422) and the stator side (i.e., stator 400, each connector arm, and foils 411 and 412) are set so as to become generally equal in mass.

The operation of the fourth embodiment is now explained. When the electromagnet constructing the stator 400 is activated by supplying the coil with an alternating current, the first mover 401 and the second mover 402 vibrate so as to slide in reciprocation in same direction together while bending each retainer, whereas the stator 400 vibrates so as to slide in reciprocation toward opposite directions of the movers 401 and 402. In response to this, not only the foil 411 and the blade 421 but also the foil 412 and the blade 422 vibrate while sliding with respect to each other.

Thus, by moving the foils 411 and 412, the shaving range can be expanded. In addition, since the movers 401 and 402 and the stator 400 especially slide in opposite phase to each other, vibration in direction of the reciprocation is reduced. As a result, vibration of the electric razor is reduced. In the fourth embodiment, since the first and second movers side and the stator side become generally equal in inertia force, the vibration of the electric razor is further reduced.

In the operation, when the first outer foil 411 or the second outer foil 412 is grasped or rather strongly pressed against the skin, the present electric razor has a tendency to restrain vibration of the stator 400. However, even though the vibration of the stator 400 is interrupted, the movers 401 and 402 relatively vibrate so as to slide in reciprocation with respect to the stator 400 and therefore it is possible to meet specified shaving performance regardless of the vibration state of the stator 400.

Figure 9:
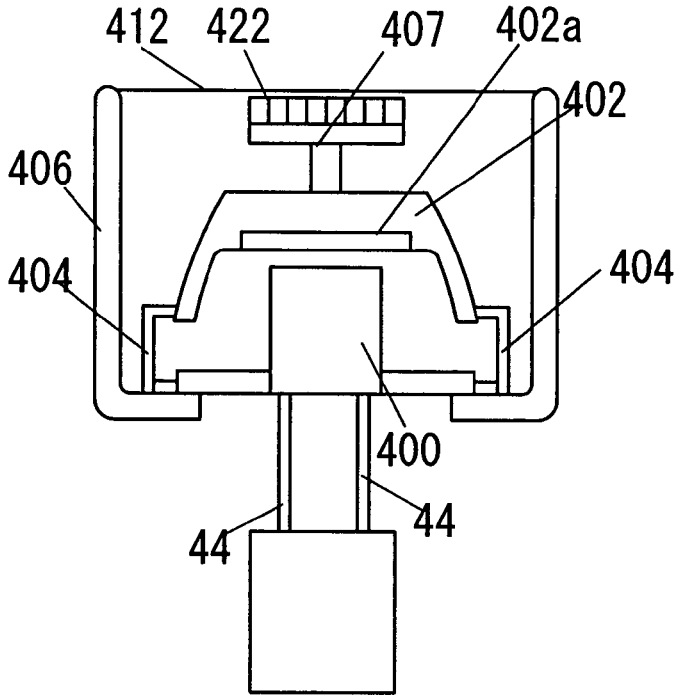
FIG. 9 is a sectional view showing a head of an alternate embodiment of the fourth embodiment.
Figure 10:
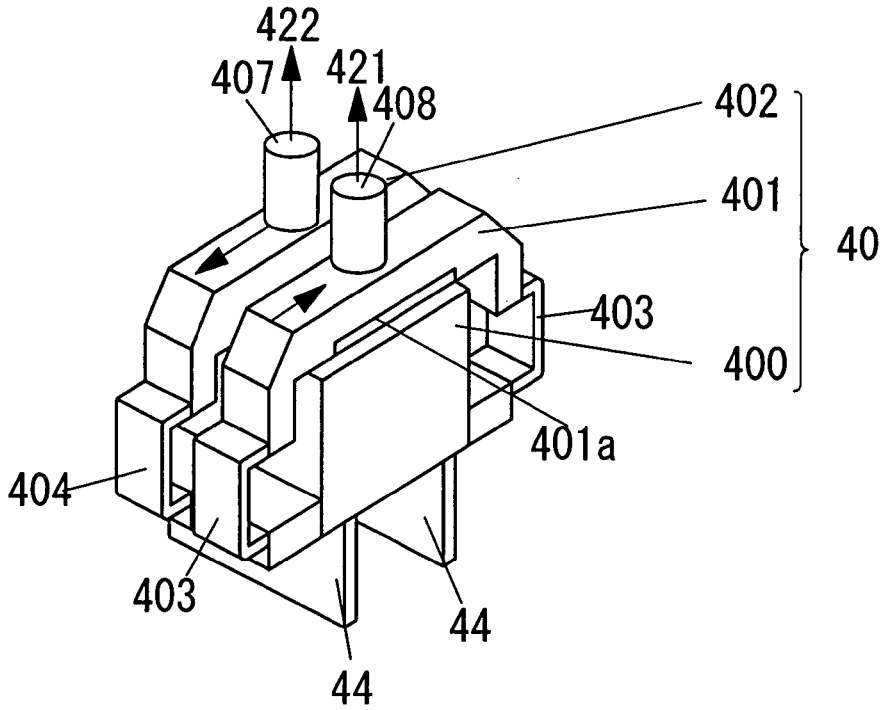
FIG. 10 is a perspective view of the head of FIG. 9.

In an alternate embodiment of the present invention, as shown in FIGS. 9 and 10, the stator 400 is supported inside the body of the electric razor through a pair of elastic support members 44 and 44 instead of a pair of support arms 45 and 45. Each member 44 is coupled between the stator 400 and a portion inside the body.

Also in FIG. 10, the first mover 401 and the second mover 402 vibrate so as to slide in reciprocation toward opposite directions to each other. That is, the first permanent magnet and the second permanent magnet are opposite in pole to each other. In addition, the first mover side and the second mover side have prescribed difference in mass. Accordingly, the stator 400 vibrates so as to slide in reciprocation toward opposite directions of one having larger mass of both movers while bending the members 44 and 44 by difference of each inertia force in vibration direction of the first mover side and the second mover side. As a result, it is possible to reduce the vibration of the electric razor and further expand the shaving range.

Although the present invention has been described with reference to certain preferred embodiments, numerous modifications and variations can be made by those skilled in the art without departing from the true spirit and scope of this invention.

The invention claimed is:

1. An electric razor wherein a linear actuator with a first vibrator and a second vibrator; and first and second outer cutters and first and second inner cutters that are respectively supported at the first vibrator and the second vibrator so that the cutters can slide against each other, wherein the actuator vibrates the first vibrator and the second vibrator so that the vibrators slide in reciprocation in opposite directions to each other, wherein the linear actuator comprises:

a stator that is constructed as an electromagnet and supported inside a body of the electric razor;

a first mover as the first vibrator, the mover having a first permanent magnet arranged opposite the electromagnet, the mover being resiliently supported at the stator; and a second mover as the second vibrator, the second mover having a second permanent magnet that has the opposite pole of the first permanent magnet and is arranged opposite the electromagnet, the second mover being resiliently supported at the stator;

wherein the linear actuator vibrates the first mover and the second mover so that the movers slide in reciprocation toward opposite directions to each other when the electromagnet is excited, and the first outer cutter and the first inner cutter are respectively supported at the first mover and the second mover so that the cutters can slide against each other; and the second outer cutter and the second inner cutter are respectively supported at the second mover and the first mover so that the cutters can slide against each other.

2. The electric razor of claim 1, wherein the first mover and the second mover slide in reciprocation in opposite directions to each other so as to absorb vibration in direction of the reciprocation.

3. The electric razor of claim 1, wherein the linear actuator is resiliently supported inside the body of the electric razor so that the actuator can freely vibrate in a direction of the reciprocation.

* * * * *